US006272806B1

(12) United States Patent
Face, III

(10) Patent No.: US 6,272,806 B1
(45) Date of Patent: Aug. 14, 2001

(54) JOINT INSERT AND METHOD/SYSTEM FOR USING SAME

(76) Inventor: S. Allen Face, III, 14 James Landing Rd., Newport News, VA (US) 23606

( * ) Notice: Subject to any disclaimer, the term of this patent is extended or adjusted under 35 U.S.C. 154(b) by 0 days.

(21) Appl. No.: 09/275,148

(22) Filed: Mar. 24, 1999

(51) Int. Cl.[7] ..... E04B 1/68

(52) U.S. Cl. ..... 52/396.04; 52/396.1; 404/64; 404/74

(58) Field of Search ..... 52/396.08, 396.1, 52/396.04; 404/64, 74

(56) References Cited

U.S. PATENT DOCUMENTS 2,068,035 * 1/1937 Meyer ..... 404/64 X
3,172,237 * 3/1965 Bradley ..... 404/64 X
3,180,238 * 4/1965 Crone ..... 404/64
3,923,411 * 12/1975 Berghman ..... 404/64
4,141,189 * 2/1979 Borjeson ..... 404/64 X
4,285,612 * 8/1981 Betti ..... 404/68
5,035,533 * 7/1991 Brown ..... 404/64
5,190,395 * 3/1993 Cathey et al. ..... 404/64 X

* cited by examiner

*Primary Examiner*—Christopher T. Kent
(74) *Attorney, Agent, or Firm*—Peter J. Van Bergen

(57) ABSTRACT

A joint insert is provided as well as a system and method for using same in the finishing of a surface's joint. The joint insert is a strip of material having a central longitudinal axis dividing the strip into first and second halves that are mirror-images about the central longitudinal axis. The strip is folded along the central longitudinal axis so that when the strip is positioned in the joint, the strip's central longitudinal axis and portions of the strip's first and second halves extend out of the joint. Gaps are formed between the joint and portions of the strip within the confines of the joint. A filler material is used to fill the gaps. As a final step in the finishing process, any of the strip and filler material extending above the plane of the surface over the joint is removed.

37 Claims, 7 Drawing Sheets

JOINT INSERT AND METHOD/SYSTEM FOR USING SAME

FIELD OF THE INVENTION

The invention relates generally to joints, and more particularly to a joint insert as well as a method for using same in a system for filling/finishing an open joint.

BACKGROUND OF THE INVENTION

Joints pose problems in a variety of situations. For example, cracks and joints in concrete slabs present a difficult maintenance problem during the early life of a structure because of the concrete's ongoing shrinkage. Since shrinkage within the concrete mass occurs over a long period of time, cracks and joints continue to grow in width long after the slab's installation. Exposed surfaces of concrete slabs subjected to repeated impact loads, such as those produced by hard wheel tires on industrial lift trucks, are susceptible to localized failure at the unprotected edges of cracks and joints because of the inherent brittleness of concrete and its weakness in both tension and shear. The breaking and crushing type failure at these unprotected edges typically caused by such exposure is generally referred to in the art as "spalling".

To reduce the likelihood of edge spalling, joints and cracks are routinely filled with sealant materials in an effort to eliminate edge exposures. Various liquid plastics including epoxies, urethanes and polyureas are available as joint fillers. The filler's ability to accommodate any subsequent slab shrinkage will be dictated by its elastic and adhesive bonding properties. While the stresses induced by slab shrinkage are resisted both in the body of the filler material and at its bonding interfaces with the concrete, eventually the tensile strength of the system can be exceeded giving rise to a phenomenon called "re-cracking". If the filler is a rigid, high-strength, high-adhesive material, the re-cracking will occur in the weakest layer of concrete adjacent to the joint. Such re-cracking creates the very same condition the filler was intended to rectify, i.e., concrete edge exposure. In an attempt to avoid such re-cracking failures in the adjacent concrete, semi-rigid, low-adhesive types of filler materials have been formulated, wherein the concrete bonding interfaces of the filler are adhesively weaker than the tensile strength of either the filler or the adjacent concrete. However, when sufficiently stressed by the concrete's shrinkage, re-cracking occurs at the filler/concrete interface, again resulting in concrete edge exposure and susceptibility to spalling under impact loading.

Various joint filling systems have also been proposed in an effort to deal with the foregoing shrinkage-induced spalling problem. Some systems include the use of plastic divider strips in an enlarged spalling repair patch, or insert elements imbedded in the filler during joint installation, all with the goal of causing re-cracking to occur within the filler itself. For example, in U.S. Pat. No. 4,875,802, joints within structural concrete bodies are filled with rigid or semi-rigid fillers to avoid adjacent concrete layer or re-cracking and protect the concrete surface edges of the joints against spalling by repeated impact loading. Inserts embedded in the fillers locationally restrict stress-induced fracture to the joints and in spaced relation to the concrete bonding interfacing interfaces of the fillers so as to maintain a filler protection for both concrete edges. However, there are problems associated with this system. First, the insert must be held in position while the filler is deposited. Second, the filler can migrate into the crack beneath the open joint. If this occurs, the filler can bond the joint or crack sufficiently to relocate the eventual re-cracking back into the adjacent concrete.

In order to overcome these problems, U.S. Pat. No. 5,088,256, discloses a method and system for finishing a joint in concrete. The bottom of the joint is provided with a seal of cement-like material which extends completely across the bottom thereof and fills the crack or fracture line beneath the joint. The lower edge of an insert is inserted partially into the cement-like seal which is in the form of a quick setting sand and cement mixture which has high compression strength and low tensile strength, and which will adhere to concrete surfaces but will not adhere to the insert. The insert is retained in a centered position in the joint by a plurality of spring clips fitted over the insert. The space above the bottom seal on each side of the insert is then filled with a filler of an epoxy or similar material which encapsulates the spring clips and fills the joint on both sides of the insert. However, this approach requires two different materials, a plurality of insert components and extra labor to install same.

SUMMARY OF THE INVENTION

Accordingly, it is an object of the present invention to provide a method and system for finishing joints formed in surfaces such as concrete slabs.

Another object of the present invention is to provide a method and system for finishing joints in a way that prevents spalling.

Still another object of the present invention is to provide a method and system of finishing joints in concrete in a way that prevents the crack beneath the joint from propagating to the surface through the adjacent concrete.

Yet another object of the present invention is to provide a method and system for finishing joints in a surface in a simple and inexpensive manner.

Other objects and advantages of the present invention will become more obvious hereinafter in the specification and drawings.

A joint insert is provided as well as a system and method for using same in the finishing of a surface's joint that has a generally rectangularly-shaped cross-section of a depth D and a width W. The joint insert is a strip of material having a central longitudinal axis dividing the strip into a first half and a second half that are mirror-images about the central longitudinal axis. The strip is folded along the central longitudinal axis. The strip is positioned in the joint such that its central longitudinal axis and a portion of each of its first and second halves extend out of the joint. Gaps are formed between the joint sidewalls and portions of the strip that are within the confines of the joint. A filler material is then used to fill the gaps. As a final step in the finishing process, any of the strip and filler material extending above the plane of the surface over the joint is removed thereby separating the strip into two identical halves which are free to move away from one another should the joint subsequently widen.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1A:
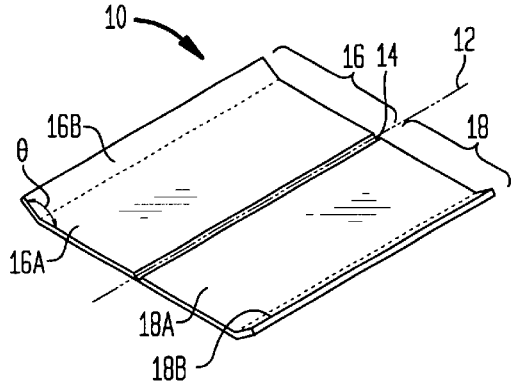
FIG. 1A is a perspective view of one embodiment of a joint insert according to the present invention prior to its use in finishing a joint.

Referring now to the drawings, and more particularly to FIG. 1A, one embodiment of a joint insert according to the present invention is shown and referenced generally by the numeral 10. Joint insert 10 is illustrative of one possible construction thereof as it would appear prior to its use in finishing a joint in a surface as will be described further below. Joint insert 10 is preferably made from a strip of pliable material, (e.g., plastic, composite, metal or other pliable material) and is symmetric or mirror-imaged about its central longitudinal axis 12. During use, joint insert 10 is folded along axis 12 with planar portions 16A and 18A being rotated toward one another so that edge portions 16B and 18B face away from one another. Accordingly, joint insert 10 can be structurally weakened along axis 12 to facilitate such folding. In many applications, it may be desirable to construct joint insert 10 along axis 12 such that planar portions 16A and 18A are spring biased away from each other after such folding. For example, joint insert 10 can be scored or notched partially or all along axis 12 as indicated at 14. Additionally or alternatively, perforations (not shown) could also be provided along axis 12. The spring biasing of planar portions 16A and 18A away from one another allows joint insert 10 to adapt to a variety of joint widths as will be described further below.

As mentioned above, axis 12 divides joint insert 10 into two mirror-image halves 16 and 18. Accordingly, a description of half 16 will also serve to describe the features of half 18. Half 16 consists of a planar portion 16A and an outboard edge portion 16B. Edge portion 16B can itself be a planar portion narrower than the planar portion 16A. Edge portion 16B could also be shaped as will be described further below. Edge portion 16B forms an angle θ with planar portion 16A. In the embodiment shown in FIG. 1A, the angle θ is oblique. However, as will be described further below, the angle θ could also be either a right or acute angle.

Figure 1B:
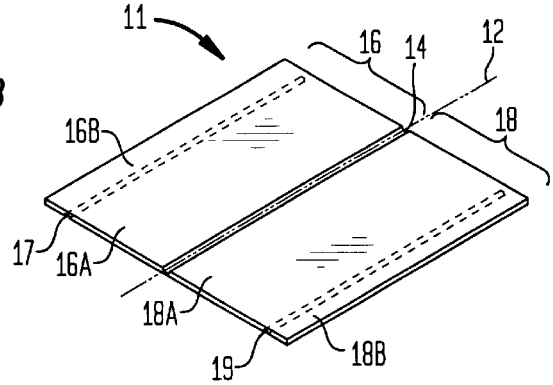
FIG. 1B is a perspective view of a joint insert according to the present invention that starts out as a flat strip that is scored longitudinally in a plurality of locations to define fold lines.

As illustrated in FIG. 1B, the joint insert need not be pre-folded at all. For example, joint insert 11 starts out with planar portions 16A and 18A and edge portions 16B and 18B being coplanar, i.e., a flat strip. The weakening or score at 14 facilitates the flexing or folding of insert 11 along axis 12 as in the previous embodiment. However, the strip is also weakened or scored longitudinally therealong at 17 and 19 (i.e., parallel to score 14) so that edge portions 16B and 18B can be angled with respect to planar portions 16A and 18A, respectively. In the illustrated embodiment, weakening or scoring at 17 and 19 is formed on the side of the strip opposite that of score 14. The advantage of having joint insert 11 start out as a flat strip is that it can be manufactured as continuous roll stock that would be cut to length and folded along its score lines at the job site.

Figure 2:
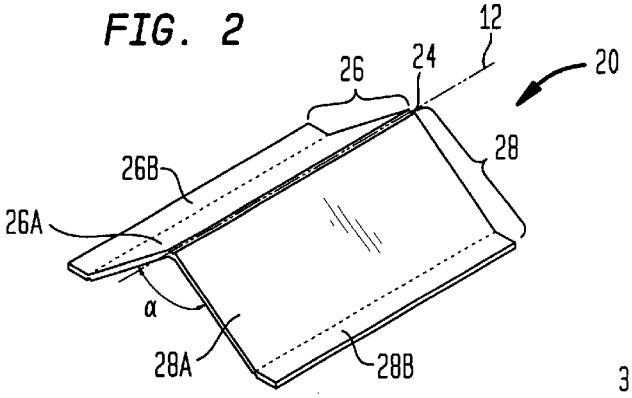
FIG. 2 is a perspective view of another embodiment of the joint insert prior to its use in finishing a joint.
Figure 3:
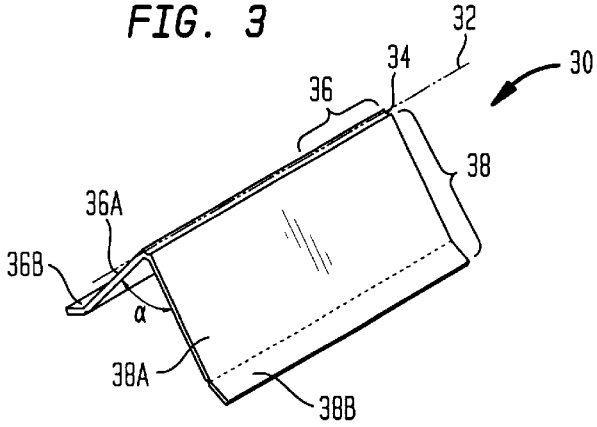
FIG. 3 is a perspective view of yet another embodiment of the joint insert prior to its use in finishing a open joint.

In the embodiments depicted in FIGS. 1A and 1B, planar portions 16A and 18A are co-planar prior to use in finishing a joint. However, this need not be the case as evidenced by other embodiments illustrated by joint inserts 20 and 30 in FIGS. 2 and 3, respectively. In each embodiment, the joint inserts are illustrated as they would appear prior to their use in finishing a joint. In each embodiment, the joint inserts are made from a pliable material to permit flexing thereof along their respective longitudinal axes 22 and 32. Note that each joint insert can also be structurally weakened (e.g., via a score 24 and 34 for inserts 20 and 30, respectively) to facilitate flexing while biasing their respective planar portions away from each other as described above with respect to joint insert 10. Each embodiment is thus similarly divided into two mirror-imaged halves about their respective central longitudinal axes such that each half has a planar and edge portion, i.e., joint insert 20 has planar portions 26A and 28A and edge portions 26B and 28B; and joint insert 30 has planar portions 36A and 38A and edge portions 36B and 38B.

Figure 7:
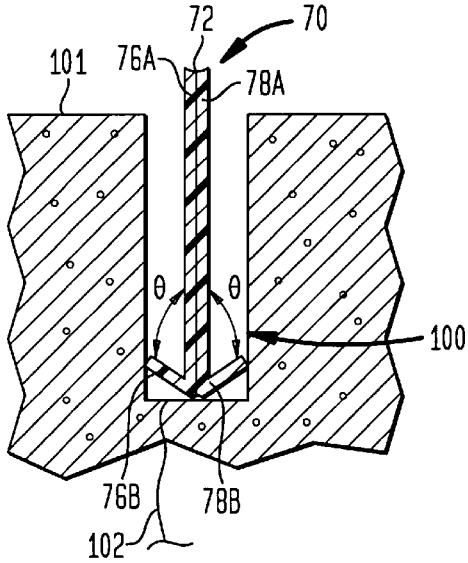
FIG. 7 is a side sectional view of still another embodiment of the joint insert in its folded configuration and positioned in a joint.

The difference in each embodiment is the pre-use angle a between planar portions of each joint insert. More specifically, the angle α between planar portions 26A and 28A is oblique while the angle α between planar portions 36A and 38A is acute. The pre-use angle α between the planar portions can be selected to facilitate a particular application or desired pre-use storage configuration. For example, when angle α is acute, installation in a joint that is smaller than expected is facilitated (FIG. 7). In terms of pre-use storage, while each joint insert lends itself to stacking, a resulting stack of inserts 10 would be shorter than an equal stacked amount of joint inserts 30. The pre-use angle α between planar portions can also be selected to minimize the amount of flexing required for the insert to assume a folded configuration as is the case with joint insert 30. Further, the pre-use angle α and/or score along the central longitudinal axis of the strip can be selected/designed to maximize the after-folded spring bias of the joint insert.

Regardless of the pre-use joint insert configuration, use of the present invention in a system and method for finishing a joint is the same. By way of example, the joint to be finished will be assumed to exist in a concrete slab. However, the joint insert, as well as the system and method of that uses same, can be used in finishing of any similar joint in any surface. Further, while a joint in most situations will be straight (e.g., a sawcut in a concrete slab), the pliable nature of the material used to make the joint insert will allow the present invention to also be used in meandering cracks and joints.

Figure 4A:
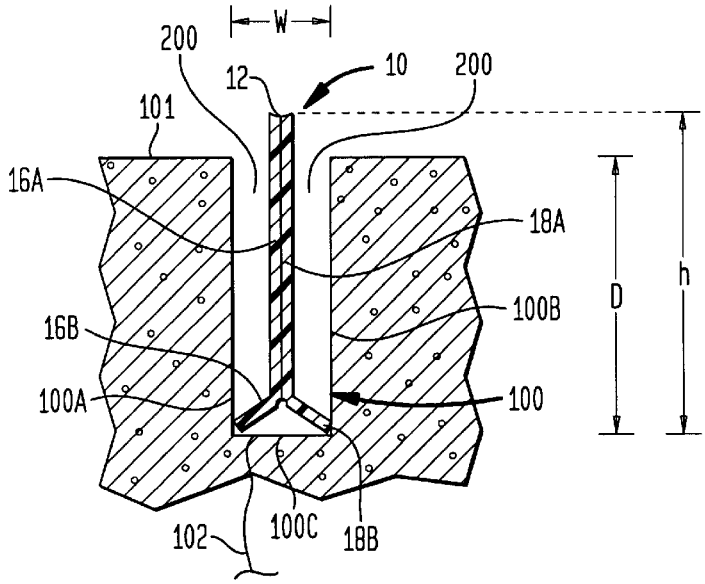
FIGS. 4A, 4B and 4C are side sectional views showing different stages in the finishing of a joint using one embodiment of the joint insert in accordance with the present invention.
Figure 4B:
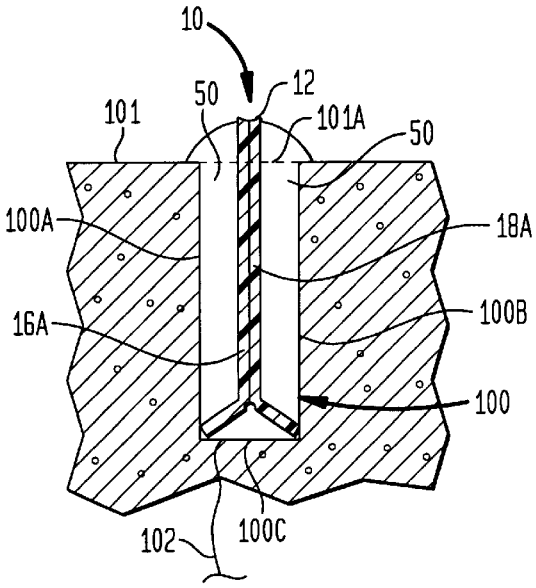
Figure 4C:
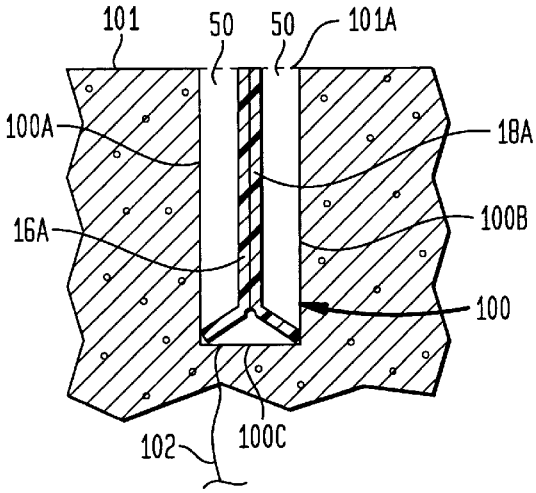

Referring now to FIGS. 4A, 4B and 4C, a joint 100 in a surface 101 such as a concrete slab is illustrated to show the various stages of finishing open joint 100 in accordance with the present invention. Joint 100 is defined by sidewalls 100A and 100B, and bottom 100C from which a crack 102 typically propagates downward. Joint 100 defines a generally rectangularly-shaped cross-section of width W and depth D. Throughout the figures, the width of joint 100 is exaggerated for purpose of illustration. In terms of a concrete slab, joint 100 is typically a made by a sawcut either during slab construction to facilitate cracking of the slab as is known in the art, or is representative of the sawcut a period of time after slab construction (i.e., after the slab has undergone some shrinkage).

In FIG. 4A, a joint insert (e.g., joint insert 10) is positioned in joint 100. More specifically, joint insert 10 is folded along central longitudinal axis 12 as described above. In the illustrated example, joint insert 10 is folded until its planar portions 16A and 18A contact or nearly contact one another while edge portions 16B and 18B face away from one another. In its folded configuration, joint insert 10 is typically positioned in joint 100 by maneuvering (e.g., pressing, sliding, etc.) same until edge portions 16B and 18B contact bottom 100C. Joint insert 10 must extend beyond (e.g., above) the confines of joint 100 to break the plane defined by surface 101. More specifically, central longitudinal axis 12 and at least a small portion of the bad, planar portions 16A and 18A extending from axis 12 must break the plane of surface 101. To guarantee this condition, the overall height h of a folded joint insert 10 (or any other embodiment of the joint insert so folded) can be made to exceed the depth D of open joint 100. Joint insert 10 self-centers itself in joint 100 due to the mirror-imaging about axis 12, the spring bias of planar portions 16A and 18A away from one another, and the pliable nature of joint insert 10. The spring bias of joint insert 10 guarantees that it will span the width W of joint 100.

In the illustrated example, planar portions 16A and 18A are shown in contact with one another (i.e., essentially parallel to one another) when joint insert 10 is inserted and ultimately positioned in joint 100. However, this need not be the case as planar portions 16A and 18A could be slightly spaced apart from one another once joint insert 10 is installed in joint 100. This will be true in cases where joint widths are slightly larger than expected. Indeed, an advantage of the present invention is that the spring bias of joint insert 10 allows it to adapt to variations in width W of joint 100 as joint insert 10 will naturally spread to span the width W. For purposes of finishing joint 100 in a concrete slab, it is preferable for planar portions 16A and 18A to be as close as possible or contact one another when joint insert 10 is positioned in joint 100. As will be explained further below, this will minimize the size of any subsequently formed gap (e.g., gap 300 illustrated in FIG. 5) as the concrete shrinks.

When positioned as shown in FIG. 4A, gaps 200 are formed between joint insert 10 and the sidewalls 100A, 100B of joint 100. As illustrated in FIG. 4B, gaps 200 are then filled with a filler material 50 that will initially flow to fill gaps 200 completely and then set. Filler material 50 can be selected from a variety of commercially available joint filler materials such as epoxies, urethanes, polyureas, etc., as is well known in the art. In terms of finishing a concrete slab to minimize spalling as the concrete shrinks, filler material 50 should be selected to attach itself or adhere chemically (e.g., an adhesive filler) or mechanically (e.g., via dovetailing of the joint insert as taught in U.S. Pat. No. 4,875,802 which is hereby incorporated by reference, by providing rough surfaces on planar portions 16A and 18A, etc.) to joint 100 and joint insert 10. For example, filler material 50 could be a relatively rigid (i.e., a hardness of approximately Shore A 80 or harder) adhesive material that attaches to joint insert 10 and the concrete at sidewalls 100A and 100B. To ensure sufficient filler material 50 is used, filler material 50 can be added until axis 12 of joint insert 10 is covered or nearly covered as illustrated.

Final finishing of joint 100 is accomplished by removing any of filler material 50 and joint insert 10 that extends outside the confines of joint 100, i.e., above the plane of surface 101 which is illustrated in FIG. 4B by dashed line 101A. This can be accomplished in a variety of ways. For example, the portion of filler material 50 in joint insert 10 extending above plane 101A can be sanded off using a sander, ground off using a grinder, sliced or cut off using a razor or other sharp blade instrument, sawed off or scraped off. When filler material 50 and joint insert 10 are both made from a plastic material, the removal thereof above plane 101A could also be accomplished by hot-wire or laser cutting. Obviously, a combination of these techniques could also be used to provide the necessary degree of finishing along plane 101A.

Figure 5:
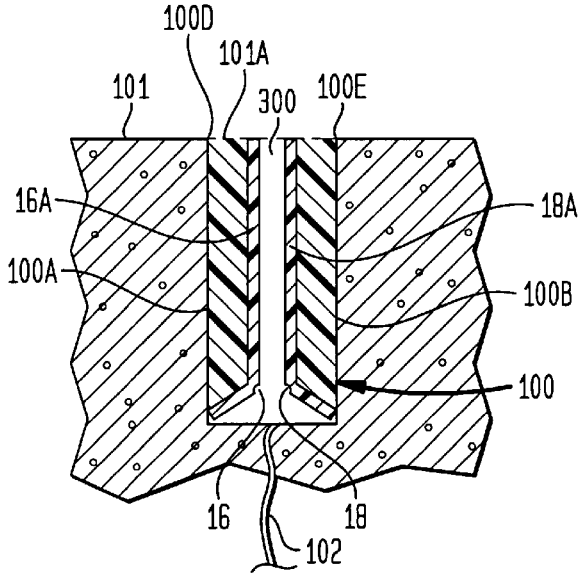
FIG. 5 is a side sectional view of a joint finished in accordance with the present invention where the joint has grown in width owing to subsequent concrete shrinkage.

As a result of such finishing, joint 100 is finished as illustrated in FIG. 4C. Specifically, the joint insert is split into two distinct and identical halves since the central longitudinal axis thereof no longer connects planar portions 16A and 18A. The advantages afforded by this joint insert and the above-described system and method of finishing a joint are numerous. First, the joint insert itself is simple and inexpensive to produce, is simply inserted, is self-centering and adapts to variations in widths of joints. By extending out of the joint during the finishing process (e.g., guaranteed by spanning a height greater than the depth of the joint in its folded configuration), the joint insert is split into two distinct halves during the finishing process. In terms of finishing joints in concrete slabs, this feature is critical. As the concrete slowly shrinks, sidewalls 100A and 100B move away from one another. With filler material 50 adhering (chemically and/or mechanically) to both sidewalls 100A and 100B of joint 100 and both halves 16 and 18 of the remaining portions of the joint insert, a gap 300 will form between planar portions 16A and 18A as illustrated in FIG. 5. Thus, the edges 100D and 100E of joint 100 remain protected by filler material 50 and planar portions 16A and 18A thereby protecting edges 100D and 100E from spalling. If desired or necessary, gap 300 can be filled to plane 101A with a filler (not shown).

Figure 6:
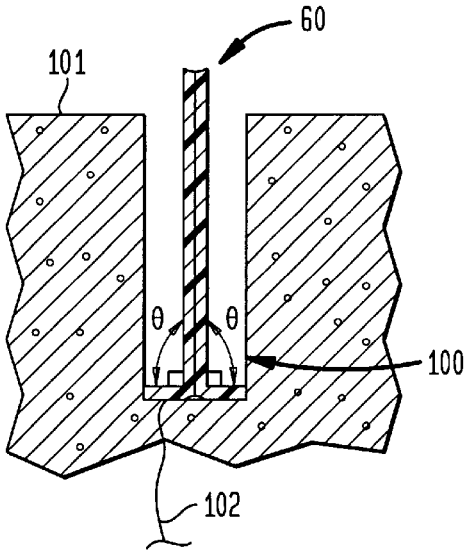
FIG. 6 is a side sectional view of another embodiment of the joint insert in its folded configuration and positioned in a joint.

Although the invention has been described relative to a specific embodiment thereof, there are numerous variations and modifications that will be readily apparent to those skilled in the art in light of the above teachings. For example, the surfaces of the planar portions of a joint insert could be smooth or formed (e.g., roughened randomly or shaped specifically) to provide mechanical keying with the filler material deposited thereagainst. As mentioned above, the angle θ between respective planar and edge portions could be a right angle as illustrated by joint insert 60 in FIG. 6, or an acute angle as illustrated by joint insert 70 illustrated in FIG. 7. Note that joint insert 70 facilitates insertion of the joint insert and easily adapts to variations in joint widths. In addition, joint insert 70 could be configured without any spring bias along its central longitudinal axis 72. Instead, joint insert 70 could be spring biased where planar portions 76A and 78A meet edge portions 76B and 78B, respectively. Specifically, edge portions 76B and 78B could be spring biased away from planar portions 76A and 78A, respectively.

Figure 8A:
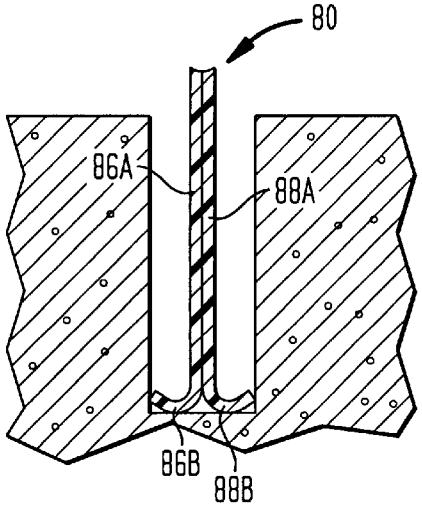
FIGS. 8A and 8B are side sectional views of other embodiments of the joint insert in which its edge portions are shaped arcuately.
Figure 8B:
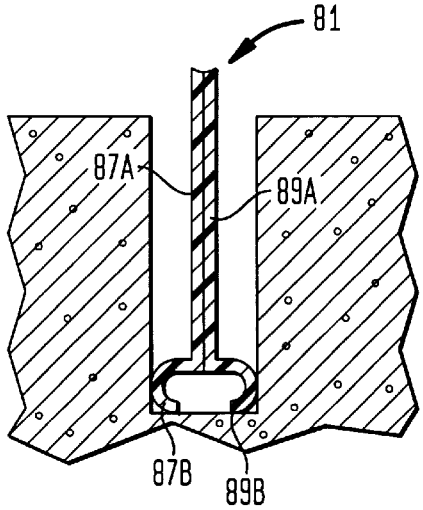
Figure 9:
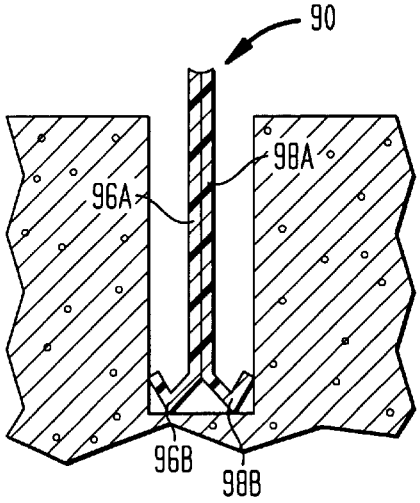
FIG. 9 is a side sectional view of another embodiment of the joint insert in which its edge portions are angularly shaped.

Further, each edge portion need not be a narrow planar portion. That is, each edge portion could be shaped, for example, as illustrated by smoothly or arcuately shaped edge portions 86B and 88B of joint insert 80 illustrated in FIG. 8A or edge portions 87B and 89B of joint insert 81 illustrated in FIG. 8B. The edge portions could also be angularly shaped such as edge portions 96B and 98B of joint insert 90 illustrated in FIG. 9.

Figure 10:
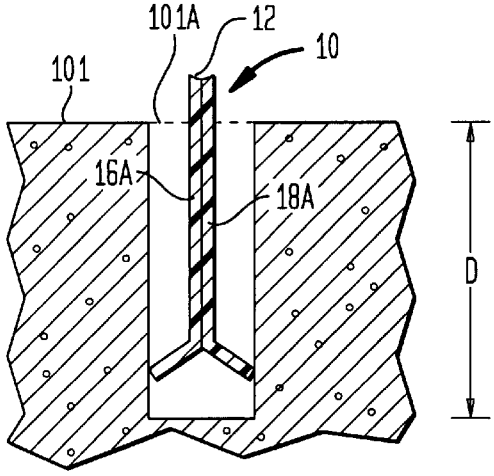
FIG. 10 is a side sectional view of another way that the joint insert can be positioned within a joint.

Still further, the above-described advantages afforded by the present invention can also be achieved when the joint insert does not fully span the depth D of joint 100. Specifically, it is sufficient that the folded portion of a joint insert (e.g., central longitudinal axis 12 and at least a small portion of planar portions 16A and 18A all along joint insert 10) break plane 101A as illustrated in FIG. 10.

Figure 11:
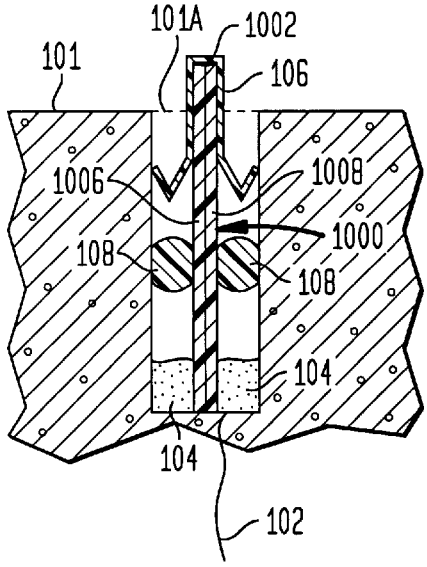
FIG. 11 is a side sectional view of still another embodiment of the joint insert of the present invention shown positioned in a joint by one or more positioners.

The advantages of the present invention could also be achieved by using a simple folded strip joint insert 1000 illustrated in FIG. 11. Joint insert 1000 is positioned in joint 100 such that its central longitudinal axis 1002 and a portion of each of planar portions 1006 and 1008 extend above plane 101A as in the above-described embodiments. Joint insert 1000 could be held in position (prior to the filling of joint 100 with a filler on either side of joint insert 1000) by one or more of sand 104 in the base of joint 100, centering clips 106 such as those described in U.S. Pat. No. 5,088,256 the contents of which are hereby incorporated by reference, centering blocks 108 of foam or other resilient material wedged on either side of joint insert 1000, or any other means of maintaining joint insert 1000 in position with its axis 1002 above plane 101A until the filler material (not shown) can hold same in position. Still further, joint insert 1000 could be made such that planar portions 1006 and 1008 have a spring bias away from one another such that joint insert 1000 assumes an inserted "V" shape when positioned in joint 100. In this way, planar portions 1006 and 1008 could spring open until they contact sidewalls 100A and 100B once joint insert 1000 has been inserted in joint 100 and released. This would eliminate the need for any of the above-mentioned positioners (e.g., sand 104, clips 106, blocks 108, etc.).

Figure 12A:
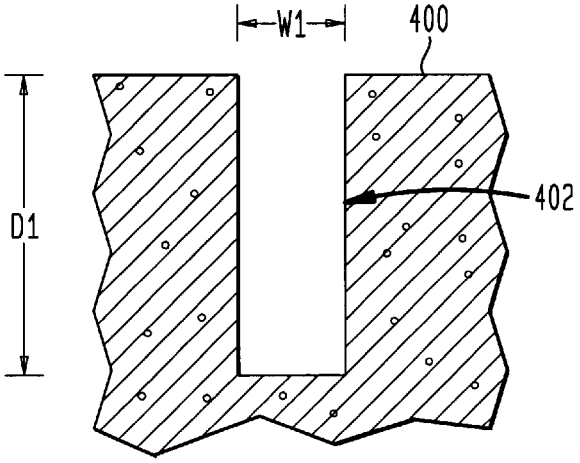
FIGS. 12A–12H are side views showing different stages in the finishing of a joint in accordance with another method of the present invention.
Figure 12B:
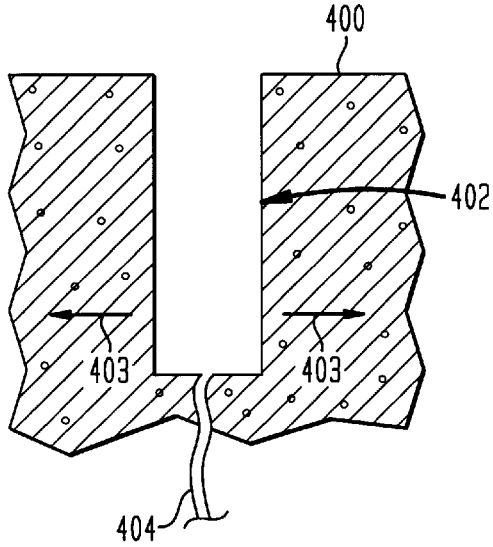
Figure 12C:
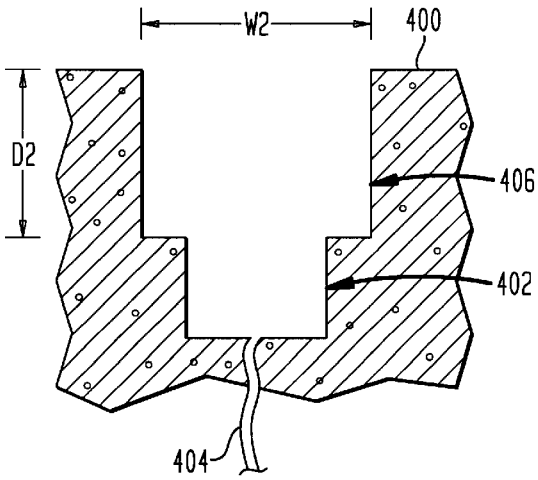
Figure 12D:
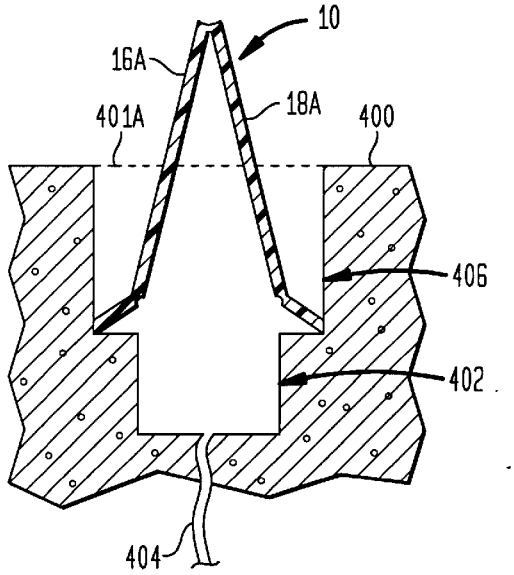
Figure 12E:
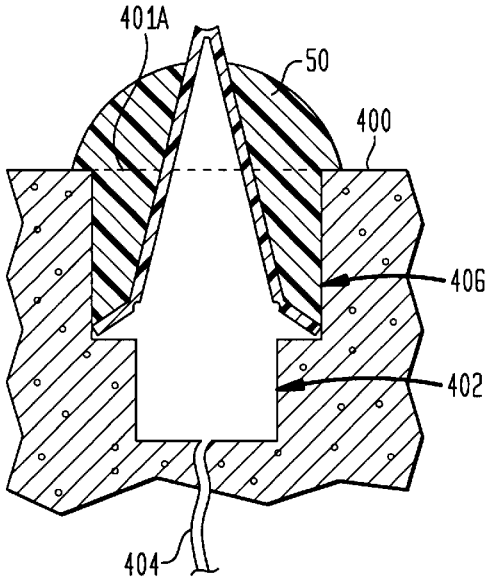
Figure 12F:
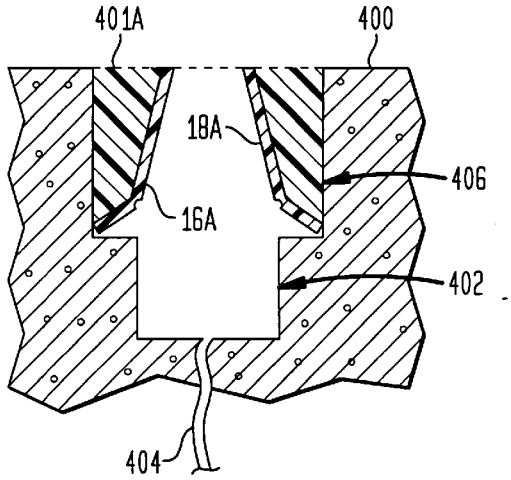

The present invention could also be practiced as depicted by the series of steps in FIGS. 12A–12H where joint width is again exaggerated for purpose of illustration. In FIG. 12A, a sawcut joint 402 of depth $D_1$ and width $W_1$ is made in a concrete slab 400 shortly after the concrete hardens. After a period of time during which slab 400 undergoes some shrinkage, joint 402 grows in width (as indicated by arrows 403) and a crack 404 forms thereunder as shown in FIG. 12B. A second wider sawcut joint 406 approximately centered over joint 402 is then made to any convenient depth $D_2$ (i.e., more than $D_1$ or less than $D_1$ as illustrated) and a width $W_2>W_1$ as illustrated in FIG. 12C. Note that because concrete shrinks over a long period of time, joint 406 may be formed while concrete slab 400 is still in its shrinking state. In FIG. 12D, a joint insert of the present invention (e.g., joint insert 10) is inserted in joint 406 to depth $D_2$ to extend beyond plane 401A of joint 406. Filler 50 is used to fill the gaps (FIG. 12E) between joint insert 10 and joint 406 as in the previous embodiments. In FIG. 12F, finishing of joint 406 entails removing any filler 50 and joint insert 10 residing above plane 401A thereby dividing the joint insert into two halves. Note that the spacing between planar portions 16A and 18A is exaggerated for clarity of illustration. Indeed, in many instances, planar portions 16A and 18A will still be in contact with one another just after the joint insert is cut along plane 401A.

Figure 12G:
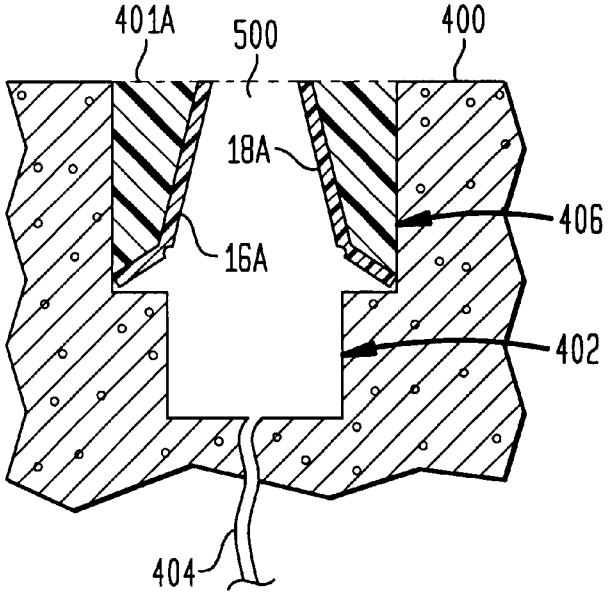
Figure 12H:
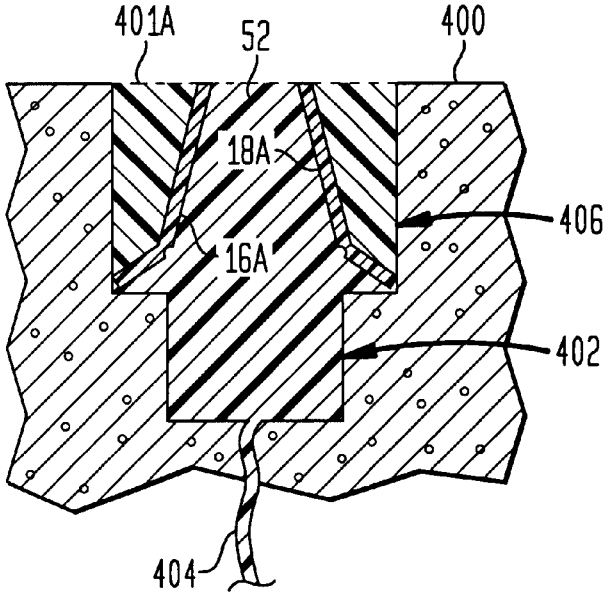

Since the concrete may continue to shrink, a gap 500 can develop or grow between the split halves of joint insert 10 as illustrated in FIG. 12G. If desired or necessary, gap 500 can be filled with a filler 52 up to plane 401A as shown in FIG. 12H. This methodology reduces the ultimate width attained by the gap (i.e., gap 500) because joint finishing takes place after some slab shrinkage has already occurred. Further, forming joint 406 just prior to finishing exposes clean and uncontaminated sides of the joint providing for better filler adhesion thereto.

It is therefore to be understood that, within the scope of the appended claims, the invention may be practiced other than as specifically described.

What is claimed as new and desired to be secured by Letters Patent of the United States is:

1. A system for finishing a surface, comprising:

a joint formed in a surface and defined by a generally rectangularly-shaped cross-section having opposing sides and a bottom with said bottom being located at a depth D with respect to said surface and with said opposing sides defining a width W of said joint;

a strip of material having a central longitudinal axis dividing said strip into a first half and a second half that are mirror-images about said central longitudinal axis, said strip being folded along said central longitudinal axis to define a folded dimension measured perpendicular to said central longitudinal axis, said folded dimension being greater than said depth D, said strip so-folded being positioned longitudinally in said joint and contacting said bottom thereof with said central longitudinal axis and a portion of each of said first half and said second half extending out of said joint wherein gaps are formed between said joint and each of said first half and said second half that are within the confines of said joint; and a filler material filling said gaps, wherein any of said strip and said filler material extending out of said joint can be removed.

2. A system as in claim 1 wherein said strip is weakened on a first side thereof along at least portions of said central longitudinal axis in order to facilitate flexing therealong.

3. A system as in claim 2 wherein said strip is weakened on a second side thereof opposite said first side and along parallel locations on either side of said central longitudinal axis.

4. A system as in claim 1 wherein said strip is pliable.

5. A system as in claim 1 wherein, when said strip is folded along said central longitudinal axis, said first half and said second half are spring biased away from one another such that said strip spans a width equal to said width W when said strip is positioned in said joint wherein said first half and said second half spring away from one another until contacting opposing sides of said joint.

6. A system as in claim 1 wherein each of said first half and said second half includes a planar portion coupled to an outboard edge portion.

7. A system as in claim 6 wherein said planar portion and said outboard edge portion meet to define an angle therebetween.

8. A system as in claim 7 wherein said angle is oblique.

9. A system as in claim 7 wherein said angle is a right angle.

10. A system as in claim 7 wherein said angle is acute.

11. A system as in claim 10 wherein each said outboard edge portion is spring biased away from its respective said planar portion.

12. A system as in claim 6 wherein said outboard edge portion is planar.

13. A system as in claim 6 wherein said outboard edge portion is arcuately shaped.

14. A system as in claim 6 wherein said outboard edge portion is angularly shaped.

15. A system as in claim 6 wherein, when said strip is folded along said central longitudinal axis, said planar portion of said first half is approximately parallel to said planar portion of said second half.

16. A system as in claim 6 wherein, when said strip is folded along said central longitudinal axis and positioned in said joint, said planar portion of said first half is in contact with said planar portion of said second half.

17. A system as in claim 11 wherein said filler material attaches to said joint and said strip.

18. A system as in claim 17 wherein surfaces of said strip contacting said filler material are shaped to mechanically key said filler material therewith.

19. A system as in claim 1 further comprising at least one positioner coupled to said strip for positioning said strip in said joint.

20. A system as in claim 1 wherein said filler material is selected to have a hardness of at least approximately Shore A 80.

21. A method of finishing a joint in a surface, said joint having a generally rectangularly-shaped cross-section of a depth D and a width W, said method comprising the steps of:

providing a strip of material having a central longitudinal axis dividing said strip into a first half and a second half that are mirror-images about said central longitudinal axis, said strip being folded along said central longitudinal axis;

inserting said strip so folded into said joint such that said central longitudinal axis and a portion of each of said first half and said second half extend out of said joint wherein gaps are formed between said joint and each of said first half and said second half that are within the confines of said joint;

filling said gaps with a filler material; and removing any of said strip and said filler material extending out of said joint.

22. A method according to claim 21 wherein said strip is flexible along at least said central longitudinal axis, said method further comprising the step of urging said first half towards said second half wherein said strip folds along said central longitudinal axis.

23. A method according to claim 22 wherein said strip is weakened along parallel locations on either side of said central longitudinal axis, said method further comprising the step of folding said strip along said parallel locations.

24. A method according to claim 21 wherein said step of removing comprises at least one step selected from the group consisting of sanding, grinding, slicing, cutting, sawing and scraping.

25. A method according to claim 21 wherein said step of inserting comprises the step of positioning said strip so that said strip fully spans said depth D of said joint.

26. A method according to claim 21 further comprising the step of centering said strip in said joint.

27. A method according to claim 21 wherein said filler material is selected to adhere to said joint and said strip.

28. A method according to claim 21 wherein said first half and said second half are spring biased away from one another when said strip is folded along said central longitudinal axis, said method further comprising the step of releasing said strip so folded after said step of inserting wherein said first half and said second half spring away from one another to contact opposing sides of said joint.

29. A method of finishing a joint in concrete, comprising the steps of:

forming a joint in a surface of concrete, said joint having a generally rectangularly-shaped cross-section of a depth D and a width W;

providing a strip of material having a central longitudinal axis dividing said strip into a first half and a second half that are mirror-images about said central longitudinal axis, said strip being folded along said central longitudinal axis;

inserting said strip so folded into said joint such that said central longitudinal axis and a portion of each of said first half and said second half extend out of said joint wherein gaps are formed between said joint and each of said first half and said second half that are within the confines of said joint;

filling said gaps with a filler material; and removing any of said strip and said filler material extending out of said joint.

30. A method according to claim 29 wherein said step of forming comprises the steps of:

forming a first sawcut in the surface of the concrete;

waiting for a period of time wherein the concrete undergoes shrinkage and wherein said first sawcut expands in width; and forming a second sawcut in the surface of the concrete, said second sawcut being approximately centered over said first sawcut so expanded wherein said second sawcut forms said joint.

31. A method according to claim 29 wherein said strip is flexible along at least said central longitudinal axis, said method further comprising the step of urging said first half towards said second half wherein said strip folds along said central longitudinal axis.

32. A method according to claim 31 wherein said strip is weakened along parallel locations on either side of said central longitudinal axis, said method further comprising the step of folding said strip along said parallel locations.

33. A method according to claim 29 wherein said step of removing comprises at least one step selected from the group consisting of sanding, grinding, slicing, cutting, sawing and scraping.

34. A method according to claim 29 wherein said step of inserting comprises the step of positioning said strip so that said strip fully spans said depth D of said joint.

35. A method according to claim 29 further comprising the step of centering said strip in said joint.

36. A method according to claim 29 wherein said filler material is selected to adhere to said joint and said strip.

37. A method according to claim 29 wherein said first half and said second half are spring biased away from one another when said strip is folded along said central longitudinal axis, said method further comprising the step of releasing said strip so folded after said step of inserting wherein said first half and said second half spring away from one another to contact opposing sides of said joint.

* * * * *